United States Patent [19]

Hoke

[11] Patent Number: 4,685,714

[45] Date of Patent: Aug. 11, 1987

[54] LIFTING ASSEMBLY

[76] Inventor: Thomas A. Hoke, R.D. #2, Red Lion, Pa. 17356

[21] Appl. No.: 943,103

[22] Filed: Dec. 18, 1986

[51] Int. Cl.[4] ..... B66C 1/02

[52] U.S. Cl. ..... 294/81.2; 294/65

[58] Field of Search ..... 294/65, 65.5, 81.2, 294/81.3, 81.5, 81.6, 81.1, 85; 248/228, 362, 363; 414/627, 737, 744 B, 752

[56] References Cited

U.S. PATENT DOCUMENTS

| | | | |
|---|---|---|---|
| 2,941,675 | 6/1960 | Noble et al. | 294/65 X |
| 3,033,382 | 5/1962 | Noble et al. | 294/65 X |
| 3,102,751 | 9/1963 | Noble et al. | 294/65 |
| 4,129,328 | 12/1978 | Littell | 294/65 |
| 4,228,993 | 10/1980 | Cathers | 294/65 X |

*Primary Examiner*—Johnny D. Cherry
*Attorney, Agent, or Firm*—Charles J. Long

[57] ABSTRACT

A lifting assembly for use with vacuum pads or the like includes a hollow load beam having a longitudinal slot in its bottom wall, a cross arm, and means suspending the cross arm below the load beam. The suspending means include a traversing member positioned within the load beam and above the longitudinal slot; roller means attached to the traversing member and in rolling contact with the internal surface of the load beam on either side of the slot; a non-rotatable traverse plate exterior to the load beam and below the traversing member; a rotation plate below and in rotationally sliding contact with the traverse plate, the top surface of the cross arm being attached to the bottom surface of the rotation plate; support means, preferably a vertical bolt, supporting the cross arm, rotation plate, and traverse plate below the traversing member and defining a vertical axis of rotation; and releasable means for locking the cross arm in any desired position along the load beam. In a preferred embodiment, releasable means are also provided for quickly and easily fixing the cross arm in any of several preselected angular positions with respect to the load beam.

5 Claims, 4 Drawing Figures

LIFTING ASSEMBLY

BACKGROUND OF THE INVENTION

1. Field of the Invention

This invention relates to lifting assemblies. More particularly, the invention relates to lifting assemblies of the type which include a load beam, one or more cross arms suspended from the load beam, and lifting devices attached to the cross arm or arms; typical of such assemblies are those including lifting pads which adhere by vacuum to flat sheets of metal or the like to lift them without causing surface or edge damage.

2. Description of Related Art

In using lifting assemblies of the type described, it is frequently necessary to move a cross arm from one position to another along the longitudinal axis of the load beam—e.g., to accommodate sheets of different sizes—and/or to position a cross arm at an angle other than 90° with respect to the load beam—e.g., to accommodate sheets of various shapes.

A typical load beam for a lifting assembly of the type described is hollow, of generally square or rectangular cross section, and has a slot extending along the longitudinal center line of the bottom wall. Typically, cross arms of prior art assemblies are suspended from the load beam by means including a metal plate or suspending pad positioned inside the load beam and bridging the slot, a downwardly extending member fastened to the lower pad surface and projecting through the slot, and means securing the cross arm to the downwardly extending member. Additionally, means may be provided to lock the pad in a desired longitudinal and/or angular position along the load beam.

Several shortcomings exist with the above-discussed prior art lifting assemblies. Chief among these is the difficulty of moving the cross arm from one position to another along the load beam, due to the fact that the weight of the cross arm and any lifting devices attached thereto causes high friction between the suspending pad and the load beam bottom wall. Additionally, the means for securing the cross arm to the above-mentioned downwardly extending member and locking it in angular and longitudinal position typically comprise merely a lock nut threaded on to the lower end of the downwardly extending member below the cross arm. Under the full weight of the cross arm it is frequently very difficult to re-tighten the lock nut after loosening it to change the position or the angle of the cross arm; conversely, however, vibration and impact during use of the lifting device can cause the lock nut to become loose and, if not noticed, come completely off, with the expected consequence that the cross arm falls from the load beam.

SUMMARY OF THE INVENTION

I have developed a lifting assembly in which the cross arm can be easily moved along the load beam and locked in position with minimal effort and, in a preferred embodiment, can be moved to different angular positions and secured there without loosening the arm from its longitudinal position on the load beam. My invention thus overcomes the above-discussed shortcomings of prior art lifting assemblies.

In accordance with the invention, I provide a lifting assembly of the type comprising a load beam and a cross arm suspended from the load beam and movable along the longitudinal axis of the load beam, the load beam being hollow and having a top wall and two side walls, each side wall having an inwardly extending flange at the bottom thereof, the flanges defining a bottom wall with a longitudinal slot therein, characterized in that the cross arm is suspended below the load beam by means comprising (a) a traversing member positioned within the load beam and above the slot therein, (b) roller means attached to and extending from each side of the traversing member and in rolling contact with the internal surface of the bottom wall of the load beam on either side of the slot, (c) support means extending between and secured respectively to the traversing member and cross arm, whereby the cross arm is supported by the support means, and (d) means for locking the cross arm in position along the longitudinal axis of the load beam.

Preferably, the support means define an axis of rotation extending through and perpendicular to the longitudinal axes of both the load beam and the cross arm, and include rotation means allowing rotation of the cross arm about the axis of rotation.

In a preferred embodiment, the axis of rotation intersects the longitudinal mid-point of the cross arm and the rotation means comprise a traverse plate positioned below and closely spaced from the load beam, means preventing rotation of the traverse plate, a rotation plate affixed to the top of the cross arm and in rotationally sliding contact with the traverse plate, and a bolt having a longitudinal axis congruent with the axis of rotation, the bolt being so constructed and arranged as to support the cross arm, rotation plate, and traverse plate below the traversing member.

In an embodiment which allows positioning of the cross arm at any of several angles with respect to the load beam, the traverse plate has vertical holes formed therethrough at locations corresponding to pre-selected angular positions of the cross arm with respect to the load beam and a vertical pin is mounted on the cross arm for vertical movement between extended and retracted positions, the pin being so located that when the cross arm is at one of the pre-selected angular positions the pin, when extended, engages the corresponding hole in the traverse plate to thereby fix the cross arm in the pre-selected angular position.

In a particularly useful embodiment, (a) the bolt has a flanged head at its lower end, is threaded at its upper end, and extends upwardly through aligned holes in the rotation plate, traverse plate and traversing member, the holes being sized to permit passage of the bolt body but not the flanged head, the threaded end of the bolt extending above the top of the traversing member; (b) a washer is positioned on the bolt in contact with the upper surface of the traversing member; (c) a castellated nut having two diametrically opposed notches formed in its upper face is threaded on the upper end of the bolt in contact with the washer; and (d) a pin is inserted through a transverse hole formed in the bolt at the level of the notches, opposite ends of the pin being positioned within the notches, whereby the nut is prevented from turning.

Further details, objects and advantages of my invention will become apparent as the following description of a present preferred embodiment thereof proceeds.

BRIEF DESCRIPTION OF THE DRAWINGS

In the accompanying drawings I have shown a present preferred embodiment of the invention in which.

DESCRIPTION OF THE PREFERRED EMBODIMENT

Figure 1:
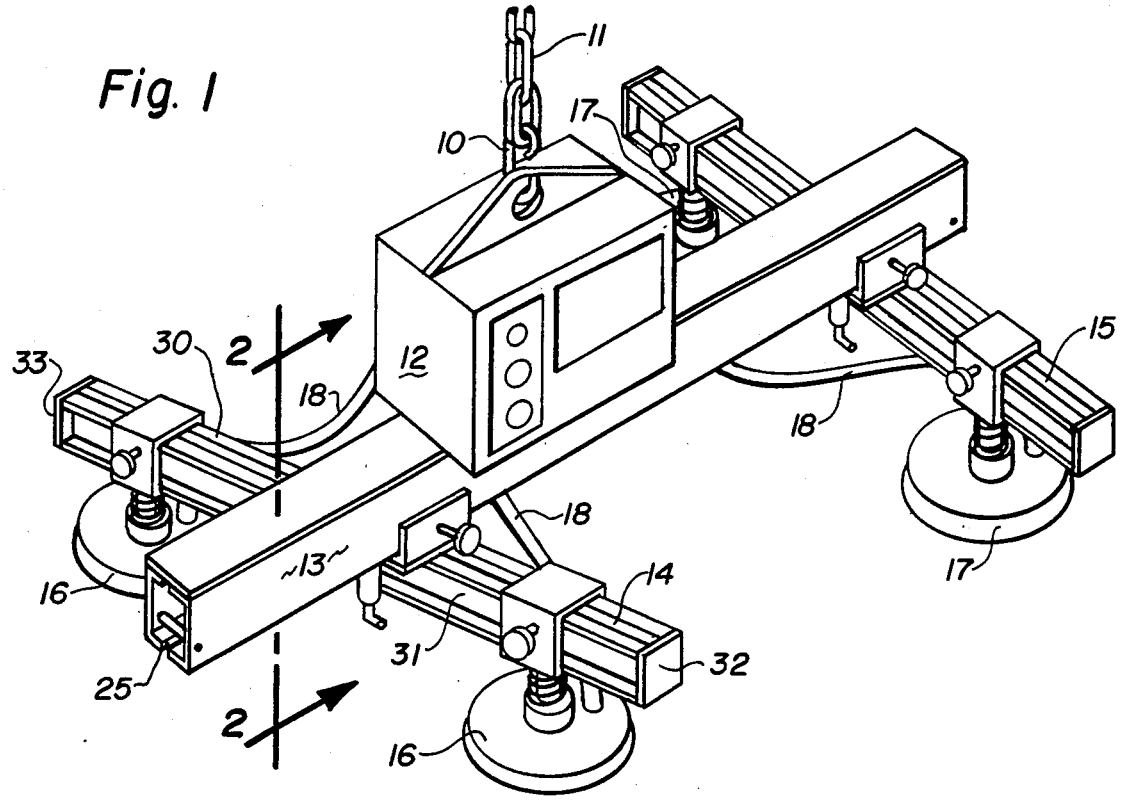
FIG. 1 is a perspective view of a lifting assembly according the invention.

Turning first to FIG. 1, there is shown a typical vacuum lifting assembly suspended from a crane hook 10 at the end of a chain 11. A vacuum generator 12 hangs from the hook 10 and supports a load beam 13 through appropriate support means, not shown. Cross arms 14 and 15 are suspended from load beam 13 by suspension means in accordance with the invention. Two vacuum lifting pads 16 are suspended from cross arm 14 and two such pads 17 are suspended from cross arm 15; the pads are connected to the vacuum generator 12 by hoses 18. Neither the vacuum pads nor the means suspending them from the cross arm form part of the invention.

Figure 2:
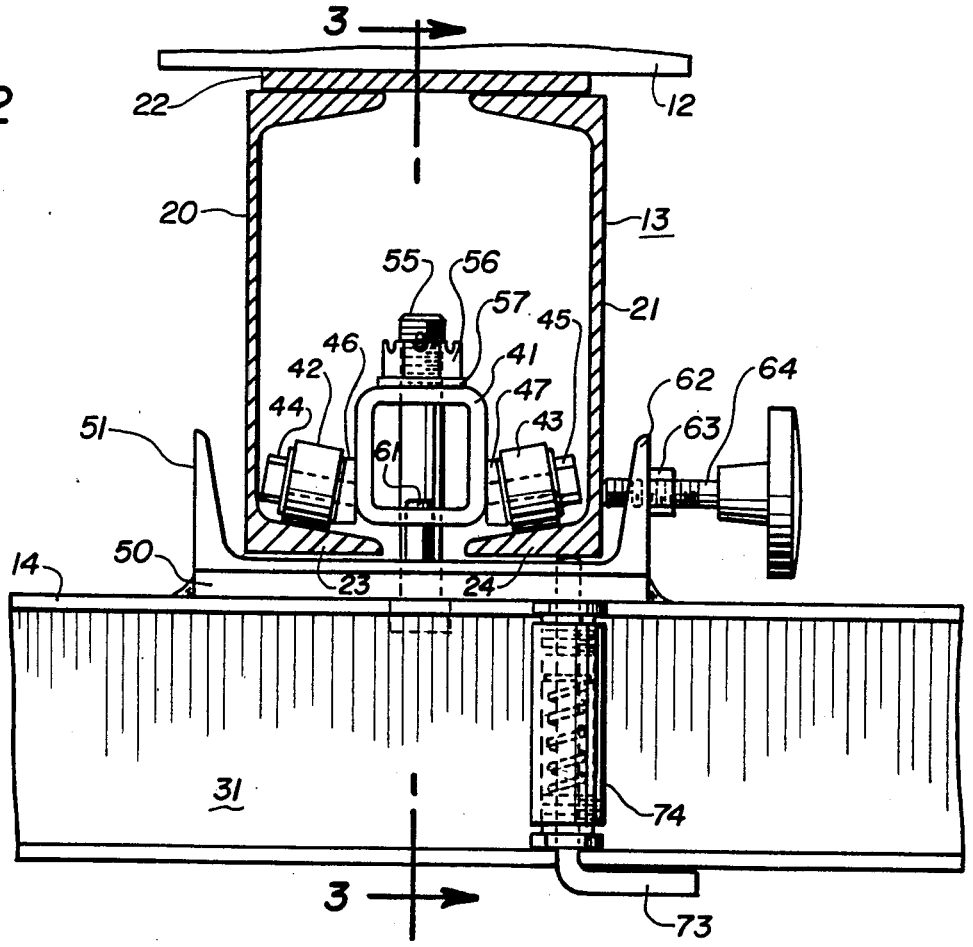
FIG. 2 is a vertical sectional view of the invention taken along line 2—2 of FIG. 1.

Referring to FIGS. 1 and 2, load beam 13 is constructed by joining the top flanges of two inwardly facing spaced apart parallel channels 20 and 21 to a co-extensive top plate 22, for example by welding. As so constructed, plate 22 forms the top wall of the load beam, the webs of channels 20 and 21 form its sidewalls, and the bottom flanges 23 and 24 of the channels form a bottom wall having a longitudinal slot therein. For an 8,000 pound capacity vacuum lifting assembly, which is a typical size in use in the art, I may use 6-foot long steel channels each having 3/16 inch web thickness, 7 inch web height and $2\frac{1}{8}$ inch flange depth; such channels are commonly available and can be ordered or cut to any desired length. Also for an assembly with such capacity, I may use a 6 foot long steel top plate of $\frac{3}{8}$ inch thickness and 5 inch width. Although I prefer the load beam construction shown in FIGS. 1 and 2, other means of fabrication could be used equally well to form a hollow load beam having a top wall and two side walls, each side wall having an inwardly extending flange at the bottom, the flanges defining a bottom wall with a longitudinal slot therein.

Figure 3:
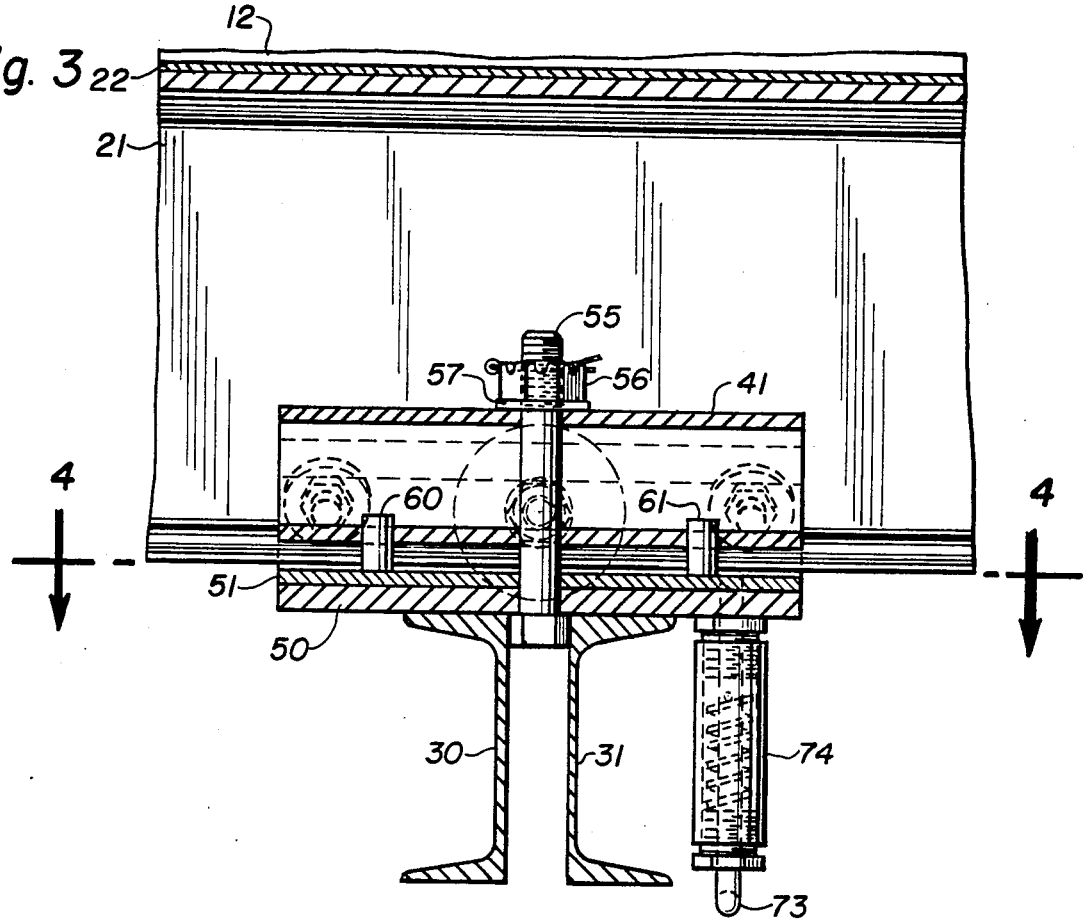
FIG. 3 is another vertical sectional view taken at right angles to FIG. 2 and along line 3—3 of FIG. 2.

Cross arms 14 and 15 are suspended from load beam 13 by means described below. As shown in FIGS. 1 and 3 for cross arm 14, the preferred cross arm is fabricated from two outwardly facing parallel spaced apart steel channels 30 and 31 welded at their ends to end plates 32 and 33. For a cross arm having a total load capacity of 4,000 pounds I prefer to use 4-foot long steel channels having 3/16 inch web thickness, 4-inch web height and $1\frac{5}{8}$ flange depth, positioned with a gap of about $\frac{7}{8}$" between them.

Referring now to FIGS. 2 and 3, the preferred means of suspending and positioning the cross arms is shown for cross arm 14. A traversing member is positioned within load beam 13 and above the longitudinal slot 25 in the bottom wall. The traversing member for the embodiment shown comprises a frame 41 which, for a typical traversing member with 4,000 pound capacity, is preferably an 8-inch long section of 2 inch square steel tubing with $\frac{1}{4}$-inch wall thickness.

As shown in FIG. 2, two roller bearings 42 and 43 are attached respectively to opposite sides of frame 41 near one end of the frame, and two like bearings, not shown in FIG. 2 but one of which is shown in broken lines in FIG. 3, are similarly attached near the other end of the frame. Bolts 44 and 45 secure bearings 42 and 43 respectively to frame 41 and are threaded into the frame at angles such that the bearing surfaces are in rolling contact with the sloping internal surfaces of flanges 23 and 24 respectively. Shims 46 and 47 maintain the lateral position of bearings 42 and 43 over the approximate mid-section of the flanges. Securing and positioning of the two bearings not visible in FIG. 2 is accomplished in the same manner as for bearings 42 and 43. For a 4,000 pound capacity traversing member I utilize $1\frac{1}{4}$-inch diameter steel roller bearings having $\frac{3}{4}$-inch wide outer rolling faces and secured to the frame by $\frac{1}{2}$-inch diameter steel bolts. It should be noted that if the load beam is so constructed that the internal surfaces of its bottom flanges are not at the angles shown in FIG. 2, the bearings are mounted at whatever angle is necessary to provide rolling contact with the flanges.

The top flanges of channels 30 and 31 of the cross arm 14 are welded to a rotation plate 50, which is longitudinally and transversely centered over the cross arm; for a 4,000 pound capacity cross arm, I use as a rotation plate a 7-inch wide by 8-inch long by $\frac{3}{8}$-inch thick steel plate. Above rotation plate 50 is a traverse plate 51 which in the embodiment shown is an upwardly open channel, the flanges of which extend upwardly on both sides of load beam 13. The length and width of traverse plate 51 are preferably the same as those dimensions of rotation plate 50. For a 4,000 pound capacity cross arm the channel forming traverse plate 51 may conveniently have the same cross section as channels 20 and 21 forming load beam 13. The bottom surface of traverse plate 51 is in rotationally sliding contact with the top surface of rotation plate 50.

Vertically aligned holes drilled through the center of rotation plate 50 and traverse plate 51 and through the top and bottom walls of frame 41 at its longitudinal and lateral midpoint are sized to allow close passage of the body of an upwardly extending hex head stove bolt 55; the head of bolt 55 is sized to fit snugly in the gap between channels 30 and 31 of cross arm 14 and abuts against the bottom surface of rotation plate 50. The length of bolt 55 is such that its threaded end extends sufficiently far above the top of frame 41 to allow a castellated nut 56 to be threaded on to the bolt with a washer 57 between it and frame 41. For a 4,000 pound capacity cross arm, I use a $\frac{5}{8}$-inch diameter by $4\frac{3}{8}$-inch long steel stove bolt having a head dimension of $\frac{7}{8}$ inch between opposite faces. Nut 56 is turned down on washer 57 sufficiently to eliminate play while still allowing rotation of cross arm 14 and rotation plate 50 about the rotation axis defined by bolt 55. When nut 56 is tightened to the desired degree a transverse hole is drilled through bolt 55 in line with diametrically opposite notches in nut 56 and a cotter pin 58 is inserted through the hole as shown to prevent loosening of nut 56.

Upstanding guide pins 60 and 61 welded to the top surface of traverse plate 51 closely fit and extend through holes formed in the bottom wall of frame 41 so as to prevent rotation of traverse plate 51 about the axis of bolt 55.

As thus far described, it will be evident that cross arm suspension means in accordance with the invention allow easy rolling movement of cross arm 14 between different positions along load beam 13, a significant improvement over the sliding plate arrangement of the prior art; in addition, the cross arm can be easily rotated about the axis of rotation defined by suspension bolt 55, while the castellated nut arrangement holding the bolt in frame 41 prevents loosening of the bolt when rotation occurs.

Referring again to FIG. 2, in order to lock cross arm 14 in position along load beam 13, a hole is formed through one flange 62 of traverse plate 51 and a threaded boss or nut 63 is welded to the outside of flange 62 having its hole aligned with the hole in the flange. A bolt 64 having a knob at one end is threaded through boss 63; to lock cross arm 14 in position, the bolt is turned in until its other end is in tight contact with the outer surface of sidewall 21 of load beam 13. To change longitudinal position of the cross arm, bolt 64 is loosened, the cross arm is moved, and the bolt is retightened at the new position.

Figure 4:
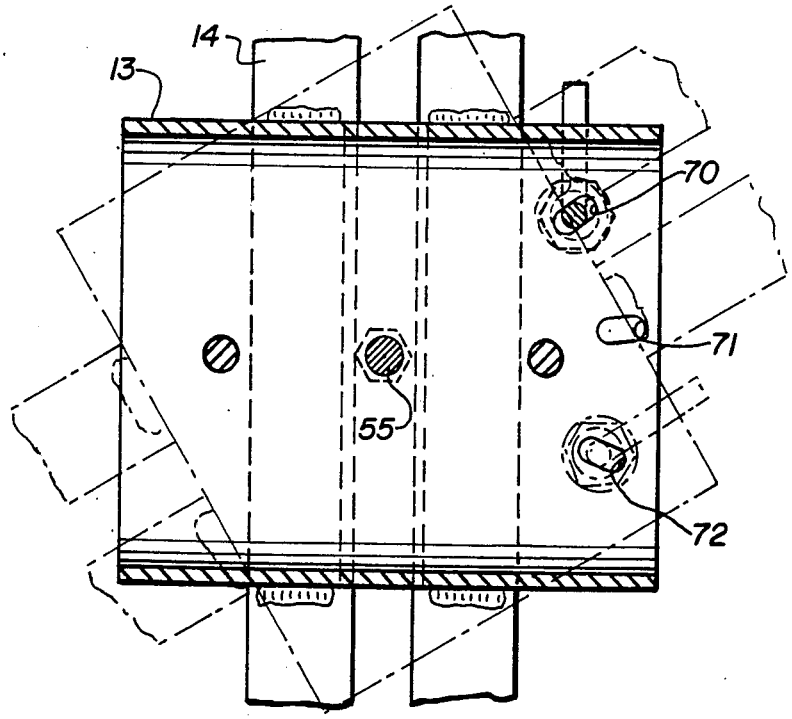
FIG. 4 is a view taken along lines 4—4 of FIG. 3 and showing a preferred means of angular positioning according the invention.

As shown in FIGS. 2, 3 and 4, means are provided for rapid and easy positioning of the cross arm 14 at any of several angles with respect to load beam 13. Holes 70, 71 and 72 are formed in traverse plate 51 corresponding to preselected angular positions of cross arm 14; although only three holes are shown in FIG. 4, it will be appreciated that more or fewer could be used depending on the number of preselected angular positions desired for the cross arm. A vertical L-shaped pin 73 is mounted in a housing 74 attached to the bottom surface of rotation plate 50 and a hole formed in rotation plate 50 allows the upper end of pin 73 to pass through the plate; pin 73 is urged upwardly to an extended position by a spring in housing 74, but can be pulled down by the horizontal leg at its bottom end to a retracted position. The length of pin 73 is such that in the retracted position its upper end is below traverse plate 51 and in the extended position its upper end extends above the web of traverse plate 51. Pin 73 is so positioned that when cross arm 14 is perpendicular to load beam 13 pin 73 is aligned with hole 70 in traverse plate 51 and thus when extended holds cross arm 14 in that position. In the example shown in FIG. 4, holes 71 and 72 are so located that pin 73 is aligned with them when cross arm 14 is at angles of 60° and 30° respectively to load beam 13. It can thus be seen that rotating cross arm 14 from first to second preselected angular positions merely involves retracting pin 73 from the hole in traverse plate 51 corresponding to the first angular position, rotating the cross arm to the second angular position, and releasing pin 73 to its extended position through the corresponding hole in traverse plate 51; such a change is shown in FIG. 4, wherein solid lines show cross arm 14 at right angles to load beam 13 and broken lines shown cross arm 14 at an angle of 30° to load beam 13.

From the foregoing it can be seen that a lifting assembly according the invention combines ease of changing cross arm positions with positive means for locking the cross arm in whatever position is desired.

While I have shown and described a certain present preferred embodiment of the invention, it is to be distinctly understood that the invention is not limited thereto but may be otherwise variously embodied within the scope of the following claims.

I claim:

1. A lifting assembly of the type comprising a load beam and at least one cross arm suspended from the load beam and movable along the longitudinal axis of the load beam, the load beam being hollow and having a top wall and two parallel side walls, each side wall having an inwardly extending flange at the bottom thereof, the flanges defining a bottom wall with a longitudinal slot therein, characterized in that the cross arm is suspended below the load beam by means comprising:

(a) a traversing member positioned within the load beam and above the slot therein;

(b) roller means attached to and extending from each side of the traversing member and in rolling contact with the internal surface of the bottom wall of the load beam on either side of the slot;

(c) support means extending between and secured respectively to the traversing member and cross arm, whereby the cross arm is supported by the support means; and (d) means for locking the cross arm in position along the longitudinal axis of the load beam.

2. A lifting assembly as claimed in claim 1, in which the support means define an axis of rotation extending through and perpendicular to the longitudinal axes of both the load beam and the cross arm, and include rotation means allowing rotation of the cross arm about the axis of rotation.

3. A lifting assembly as claimed in claim 2, in which the axis of rotation intersects the longitudinal mid-point of the cross arm and the rotation means comprise a traverse plate positioned below and closely spaced from the load beam, means preventing rotation of the traverse plate, a rotation plate affixed to the top of the cross arm and in rotationally sliding contact with the traverse plate, and a bolt having a longitudinal axis congruent with the axis of rotation, the bolt being so constructed and arranged as to support the cross arm, rotation plate, and traverse plate below the traversing member.

4. A lifting assembly as claimed in claim 3, in which the traverse plate has vertical holes formed therethrough at locations corresponding to pre-selected angular positions of the cross arm with respect to the load beam and a vertical pin is mounted on the cross arm for vertical movement between extended and retracted positions, the pin being so located that when the cross arm is at one of the pre-selected angular positions the pin, when extended, engages the corresponding hole in the traverse plate to thereby fix the cross arm in the pre-selected angular position.

5. A lifting assembly as claimed in claims 3 or 4, in which (a) the bolt has a flanged head at its lower end, is threaded at its upper end, and extends upwardly through aligned holes in the rotation plate, traverse plate and traversing member, the holes being sized to permit passage of the bolt body but not the flanged head, the threaded end of the bolt extending above the top of the traversing member;

(b) a washer is positioned on the bolt in contact with the upper surface of the traversing member;

(c) a castellated nut having two diametrically opposed notches formed in its upper face is threaded on the upper end of the bolt in contact with the washer; and (d) a pin is inserted through a transverse hole formed in the bolt at the level of the notches, opposite ends of the pin being positioned within the notches, whereby the nut is prevented from turning.

* * * * *